US005916296A

United States Patent [19]

Honda

[11] Patent Number: 5,916,296

[45] Date of Patent: Jun. 29, 1999

[54] DUAL PROCESSOR AUTOMOTIVE CONTROL SYSTEM HAVING FLEXIBLE PROCESSOR STANDARDIZATION

[75] Inventor: Takayoshi Honda, Nagoya, Japan

[73] Assignee: Nippondenso Co., Ltd., Kariya, Japan

[21] Appl. No.: 08/659,496

[22] Filed: Jun. 5, 1996

[30] Foreign Application Priority Data

Jun. 5, 1995 [JP] Japan ..... 7-138242

[51] Int. Cl.[6] ..... F02D 41/00

[52] U.S. Cl. ..... 701/115; 701/102; 123/406.16

[58] Field of Search ..... 701/115, 102, 701/112, 114; 395/425; 364/431.12; 123/480, 406.12, 406.13, 406.16

[56] References Cited

U.S. PATENT DOCUMENTS

| | | | |
|---|---|---|---|
| 4,556,943 | 12/1985 | Pauwels et al. | 701/115 |
| 4,730,256 | 3/1988 | Niimi et al. | 364/431.12 |
| 4,943,924 | 7/1990 | Kanegae et al. | 701/115 |
| 5,138,548 | 8/1992 | Kienle | 395/425 |
| 5,247,446 | 9/1993 | Motz et al. | 701/115 |
| 5,523,948 | 6/1996 | Adrain | 701/115 |
| 5,526,267 | 6/1996 | Sogawa | 701/115 |
| 5,531,200 | 7/1996 | Hosoe et al. | 701/115 |
| 5,586,034 | 12/1996 | Takaba et al. | 701/115 |
| 5,826,211 | 10/1998 | Kobayashi | 123/480 |

FOREIGN PATENT DOCUMENTS

| | | | |
|---|---|---|---|
| 62-200432 | 9/1987 | Japan | 701/115 |
| 4-328603 | 11/1992 | Japan | 701/115 |
| 5-268664 | 10/1993 | Japan | 701/115 |
| 7-208256 | 8/1995 | Japan | 701/115 |

*Primary Examiner*—Willis R. Wolfe
*Assistant Examiner*—Hieu T. Vo
*Attorney, Agent, or Firm*—Pillsbury Madison & Sutro LLP

[57] ABSTRACT

To execute high-accuracy control employing communication data of a microprocessor while attempting standardization of the microprocessor, a host microprocessor is provided with a ROM, RAM, CPU, and DMA controller, and a KCS microprocessor is provided with a ROM, RAM, CPU, and DMA controller. The host microprocessor and the KCS microprocessor are connected by a bidirectional communication line. At a predetermined cycle, the CPU of the host microprocessor sends data in the ROM relating to the content of control of the KCS microprocessor to the RAM of the KCS microprocessor. Engine information (A/D values and so on) are sent from the KCS microprocessor to the host microprocessor at a cycle of 4 ms, but sending of ROM data from the host microprocessor to the KCS microprocessor is performed during free time in this sending cycle. The ROM data is divided into a plurality of blocks, and the data is sent block by block.

26 Claims, 8 Drawing Sheets

DUAL PROCESSOR AUTOMOTIVE CONTROL SYSTEM HAVING FLEXIBLE PROCESSOR STANDARDIZATION

CROSS-REFERENCE TO RELATED APPLICATION

The present application is related to and claims priority from Japanese Patent Application No. Hei. 7-138242, incorporated herein by reference.

BACKGROUND OF THE INVENTION

1. Field of the Invention

The present invention relates to an electronic control device for automotive use which utilizes a plurality of microprocessors to perform engine control and other vehicle control.

2. Description of Related Art

Along with recent diversification and growth in complexity of control, a need has appeared for a plurality of microprocessors in an electronic control unit for vehicle use, and technology has been developed to perform data communication among the various microprocessors. Additionally, technology which can standardize microprocessors for use even with different vehicle models and changes in specifications is also desired from the standpoint of lower cost.

In this regard, a control device of an engine for vehicle use is disclosed in, for example, Japanese Patent Application Laid-Open Publication No. 61-16250 as an example of of microprocessors. With this control device, specific data for each specification which corresponds to change in specifications is previously stored in a ROM of a first microprocessor, and standard data with no change in specifications is previously stored in a ROM of a second microprocessor. Accordingly, at a time of initialization, the contents of data (i.e., a control map) stored in the ROM of the first microprocessor is sent to the second microprocessor, and along with this, the memory settings for the microprocessor are made, and the second microprocessor executes control on the basis of the control map in RAM at that time, i.e, the map data which has been stored in the first microprocessor. Standardization of the second microprocessor can be achieved in such cases.

However, the problem described below occurs in such prior art control devices. Namely, in the foregoing device, data communication from the first microprocessor to the second microprocessor is performed only during initialization. For this reason, problems such as operation of the second microprocessor with incorrect control data or failure of control of the second microprocessor to start may occur in a case where communication during initialization is not performed correctly.

Additionally, in a case of a microprocessor installed on a vehicle, control data within RAM may be destroyed by usage under poor conditions (high temperature or high humidity) or by occurrence of noise due to drive pulses of the ignition system or the like, making it impossible to perform normal operation.

SUMMARY OF THE INVENTION

In light of the foregoing problem, it is an object of the present invention to provide an electronic control device for automotive use which can execute high-accuracy control employing communication data of a microprocessor while attempting standardization of the microprocessor.

Further, it is an object of the present invention to achieve commonality of a second microprocessor, as well as to compensate accurate operation of the second microprocessor.

The above objects are achieved according to a first aspect of the present invention by providing an electronic control system including first and second microprocessors in which commonality of the second microprocessor is achieved by storing default values corresponding to a multiplicity of models in a RAM of the second microprocessor which determines operation of the second microprocessor.

Further, by periodically sending control data which is dedicated to various engines to cause operation of the second microprocessor to correspond to the various engines from a first microprocessor to the second microprocessor, the second microprocessor operates optimally with respect to the various engines, and further, destruction of permanent data in the RAM of the second microprocessor is prevented, and accurate operation can be obtained.

In this way, a favorable effect is demonstrated in being able to execute high-accuracy control employing communication data of a microprocessor while attempting standardization of the microprocessor.

Operation of the second microprocessor can reliably be performed at a time of application of a power source or the like. Also, it is possible that control operation of a second microprocessor utilizing ROM data of a first microprocessor can be executed with favorable accuracy while giving priority to performing control operation of the first microprocessor.

Other objects and features of the invention will appear in the course of the description thereof, which follows.

BRIEF DESCRIPTION OF THE DRAWINGS

Additional objects and advantages of the present invention will be more readily apparent from the following detailed description of preferred embodiments thereof when taken together with the accompanying drawings in which.

DETAILED DESCRIPTION OF THE PRESENTLY PREFERRED EXEMPLARY EMBODIMENTS

A preferred embodiment of the present invention as used in an electronic control device for automotive use will be described hereinafter with reference to the drawings.

The engine control device of the present invention has an ECU (electronic control unit) which incorporates a plurality of mutually communicable microprocessors, and engine control such as fuel-injection control, ignition-timing control, and knock control are performed by the ECU. In particular, the present embodiment will be described regarding an engine control device provided with a host microprocessor which governs primary engine control such as fuel-injection control and ignition-timing control, and a microprocessor for knock-control system use (hereinafter termed a "KCS microprocessor") which governs calculation of detection data for an engine-operation state as well as knock processing.

Figure 2:
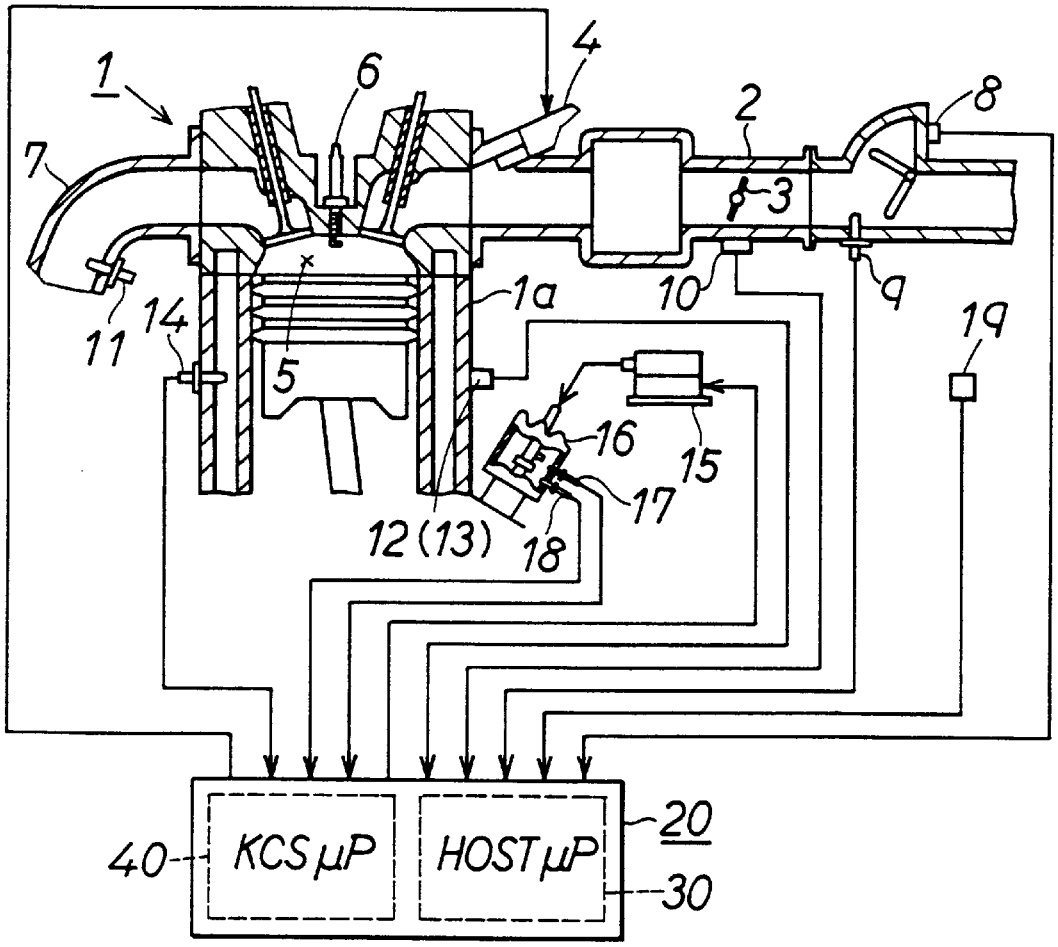
FIG. 2 is a structural diagram indicating an entirety of an engine control device in the embodiment.

FIG. 2 shows an overall structure of an engine control system. An engine 1 is a spark-ignition type direct in-line six-cylinder gasoline engine, and a throttle valve 3, the actuation of which is linked to depression of an accelerator pedal (not illustrated) is disposed in an intake line 2 of the engine 1. An electromagnetically driven injector 4 is disposed at a most downstream portion of the intake line 2, and a spark plug 6 is disposed in a combustion chamber 5 of each of the cylinders. In this case, intake air which has passed through the throttle valve 3 is mixed with sprayed fuel from the injector 4, and this air-fuel mixture is sucked into the combustion chambers 5 of each cylinder. The air-fuel mixture sucked into the combustion chamber 5 is ignited by a spark from the spark plug 6, combusts and thereafter passes through an exhaust pipe 7 and is discharged to the outside.

Meanwhile, an air-flow meter 8 to detect an amount of intake air flow is disposed in an upstream portion of the intake line 2 of the engine 1, and an intake-temperature sensor 9 to detect temperature of the intake air is disposed proximately thereto. Additionally, a throttle opening sensor 10 to detect an opening degree of the throttle valve 3 is installed on the valve 3. An oxygen-concentration sensor 11 to detect oxygen concentration in exhaust gas is disposed in the exhaust pipe 7.

Figure 3:
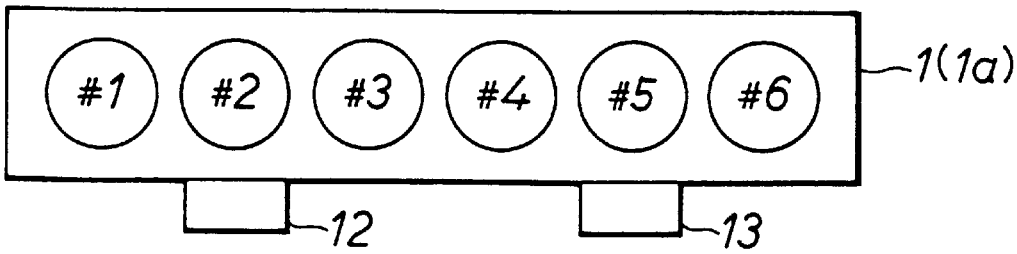
FIG. 3 is a drawing indicating installation positions of knock sensors in an engine in the embodiment.

In addition, two knock sensors 12 and 13 to detect knocking which occurs in the engine 1 and a water-temperature sensor 14 to detect temperature of coolant water circulating within a cylinder block 1*a* of the engine 1 are disposed in the cylinder block 1*a*. As shown in FIG. 3, one knock sensor 12 detects knocking which occurs in the first (#1) through third (#3) cylinders of the engine 1, and the other knock sensor 13 detects knocking which occurs in the fourth (#4) through sixth (#6) cylinders of the engine 1. In this case, when the ignition sequence is established to be #1→#5→#3→#6→#2→#4→#1, signals of the two sensors 12 and 13 are alternatingly employed to perform knock detection for the several cylinders.

An igniter 15 generates high voltage from battery voltage at a predetermined timing, and a distributor 16 distributes the high voltage from the igniter 15 to the spark plugs 6 of the cylinders. A cylinder discrimination sensor 17 which outputs a cylinder-discrimination signal at a specific position of a specific cylinder (for example, compression TDC of the first cylinder) accompanying rotation of a crankshaft of the engine 1 and a crank angle sensor 18 which outputs a crank angle signal at every predetermined crank angle (for example, every 30° CA) accompanying rotation of the crankshaft of the engine 1 are installed on the distributor 16.

The detection signals of these several sensors are received by the ECU 20, and the ECU 20 controls ignition timing of the igniter 15 and fuel injection by the injector 4 on the basis of the foregoing detection signals. A starter signal from a starter switch 19 is also input to the ECU 20 in addition to the above-described sensors. The ECU 20 has a host microprocessor 30 as a first microprocessor and a KCS microprocessor 40 as a second microprocessor. The electrical structure within the ECU 20 will be described hereinafter with reference to FIG. 1.

Figure 1:
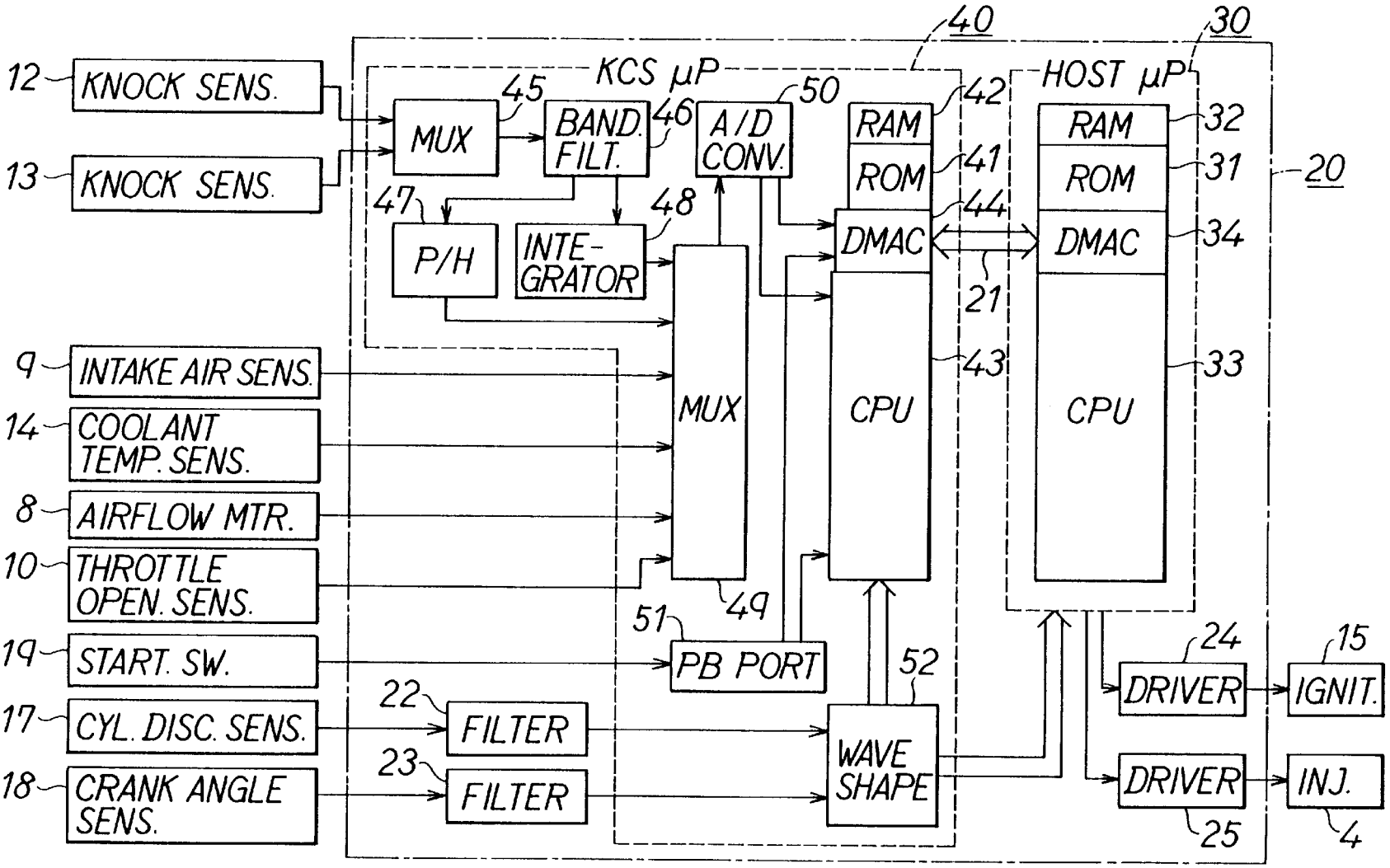
FIG. 1 is a drawing indicating an electrical structure of an ECU according to a preferred embodiment of the present invention.

In FIG. 1, the host microprocessor 30 and the KCS microprocessor 40 are connected by a communication line 21 which is bidirectionally communicable. In addition to performing tasks such as knock detection and failure detection of the knock sensors 12 and 13 on the basis of the output signals of the knock sensors 12 and 13, the KCS microprocessor 40 generates various digital signals which indicate an engine operating state in accordance with an A/D conversion request or the like from the host microprocessor 30. Meanwhile, in addition to performing ignition control to reduce knocking and the like by adjusting ignition timing on the basis of various data (intake air quantity, intake temperature, water temperature, and so on) sent from the KCS microprocessor 40, the host microprocessor 30 controls electrification and operation of the injector 4 to perform fuel injection control.

The structure of the KCS microprocessor 40 will be described in detail hereinafter. In the KCS microprocessor 40, after output signals from the knock sensors 12 and 13 (hereinafter termed "knock signals") are received by a multiplexer 45, the knock signals pass through a bandpass filter 46 and are received by a peak-hold circuit (P/H circuit) 47 and an integrating circuit 48. Herein, the bandpass filter 46 causes only components of a specific frequency band of the knock signals to be passed. The P/H circuit 47 holds a peak value of a knock signal within a predetermined gate interval (i.e., a knock-detection interval established in correspondence with a predetermined crank angle). The integrating circuit 48 calculates an integral value of the knock signals within a gate region. Accordingly, the several detection signals of the P/H circuit 47 and integrating circuit 48 are received by a multiplexer 49.

The several sensor signals of the above-described air-flow meter 8, intake temperature sensor 9, throttle-opening sensor 10, water-temperature sensor 14, and the like are input to the multiplexer 49 in addition to the several output signals of the foregoing P/H circuit 47 and integrating circuit 48, and the multiplexer 49 selectively switches the several signals and outputs the selected value to an A/D converter 50. The A/D converter 50 sequentially performs A/D conversion of the output signals from the multiplexer 49.

Additionally, a dual input-output port (hereinafter termed "PB port") 51 of the KCS microprocessor 40 outputs either a high or low signal in correspondence with a voltage level applied, for example, to the starter switch 19.

Furthermore, fixed data and various programs are stored in a ROM (read-only memory) 41 in the KCS microprocessor 40. Various data is temporarily stored readably and writably in a RAM (random-access memory) 42. A CPU (central processing unit) 43 performs various processing such as knock detection and failure detection of the knock sensors 12 and 13 on the basis of programming stored in the ROM 41. A DMA controller (direct memory access controller) 44 performs direct exchange of data between the RAM 42 and an external device (the host microprocessor 30) without passing through the CPU 43.

Moreover, pulse signals from the cylinder discrimination sensor 17 and the crank-angle sensor 18 undergo noise removal by filters 22 and 23, and thereafter are input to a waveform-shaping circuit 52 of the KCS microprocessor 40. The waveform-shaping circuit 52 shapes the waveforms of output of the two sensors 17 and 18 and generates an engine speed signal and reference position signal.

Meanwhile, the host microprocessor 30 is provided with a ROM 31, RAM 32, CPU 33, and DMA controller 34 similar to the foregoing. In this case, the CPU 33 generates an ignition-timing control signal and fuel-injection control signal on the basis of several control programs in the ROM 31, and outputs these signals to drive circuits 24 and 25. The drive circuits 24 and 25 drive the igniter 15 and injector 14 on the basis of the foregoing ignition-timing control signal and fuel-injection control signal.

According to the present embodiment, a sending device is implemented by the CPU 33 of the host microprocessor 30, and a RAM-data updating device is structured by the DMA controller 44 of the KCS microprocessor 40.

Herein, control data (specific data) which can be changed for each engine type or each engine specification is priorly established in the ROM 31 of the host microprocessor 30, and control data which is used by the KCS microprocessor 40 is also included therein. Accordingly, ROM data of the host microprocessor 30 is sent via the communication line 21 to the RAM 42 of the KCS microprocessor 40 during microprocessor operation, and the KCS microprocessor 40 employs the RAM data (ROM data of the host microprocessor 30) at that time to perform A/D conversion processing, knock processing (knock detection and failure determination of the knock sensors), and the like. In specific terms, data (1) through (5) which will be described hereinafter are stored in the ROM 31 of the host microprocessor 30, and this information is sent to the DMA controller of the host microprocessor 30 and, via the communication line 21, to the DMA controller 44 and RAM 42 of the KCS microprocessor 40.

(1) "GMASK" corresponding to open time (angle) of the gate region;

(2) "GKCS" corresponding to closed time (angle) of the gate region;

(3) Failure-determination level to determine whether the knock sensors 12 and 13 are normal or abnormal;

(4) Conformity value (ADJ value or the like) established for each engine; and (5) Constant (U value) to correct a knock-determination level for each cylinder.

Meanwhile, standard values (default values) which correspond to the ROM data of the host microprocessor 30 are priorly established in the ROM 41 of the KCS microprocessor 40 as standard control data which becomes applicable to a multiplicity of engine and vehicle types (being at least data for which there is no danger of engine destruction), rather than as specific data. In specific terms, data corresponding to the above-described data (1) through (5) is stored, and in a case where the KCS microprocessor 40 independently performs processing for knock detection, failure determination, or the like, calculation is performed utilizing the foregoing default values.

That is to say, data of the same type (i.e., the data of the foregoing data (1) through (5)) is stored in the ROMs 31 and 42 of both microprocessors 30 and 40, but the data of the ROM 31 is specific data for various engines, such as high-output engines and low fuel consumption engines, and the data in the ROM 41 is data which has been standardized to the extent that at least engine destruction will not occur.

Figure 4:
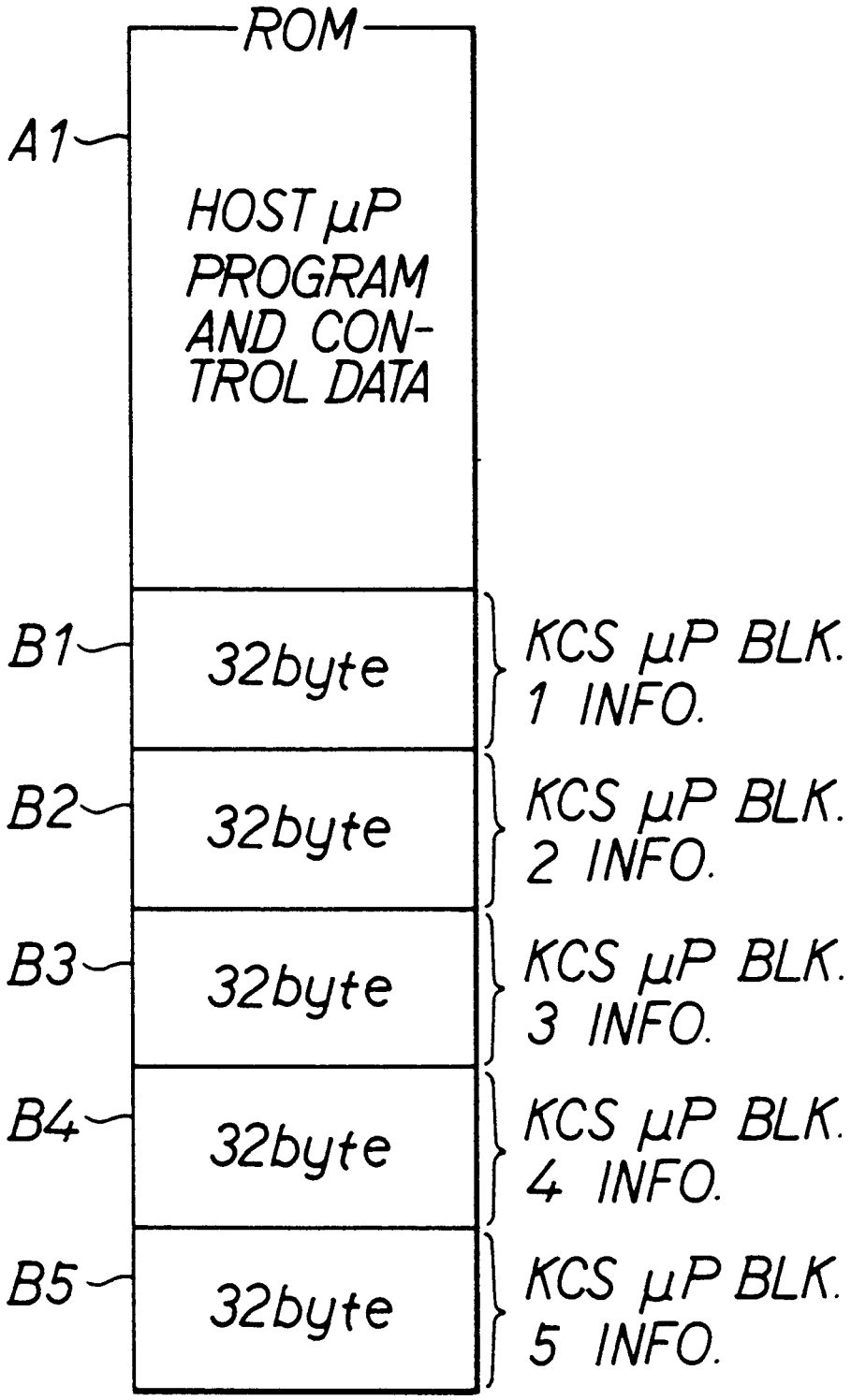
FIG. 4 is a schematic drawing indicating memory regions of a ROM of a host microprocessor according to the embodiment.

FIG. 4 schematically shows memory regions of the ROM 31 of the host microprocessor 30. In FIG. 4, the ROM 31 is provided with an A1 region in which operation programs and control data (for example, information utilized in ignition-timing control and fuel-injection control) of the host microprocessor 30 are stored, and B1 through B5 regions in which control information utilized by the KCS microprocessor 40 is stored. The several memory regions of B1 through B5 are divided into 32 byte blocks, and information divided into block 1 through block 5 is established in the respective regions.

In this case, the information of block 1 of the KCS microprocessor 40 corresponds to the above-described "GMASK" and "GKCS," and the information of block 2 corresponds to the failure-determination level and conformity value (ADJ value or the like. The information of block 3 corresponds to the U values of the first and second cylinders, the information of block 4 corresponds to the U values of the third and fourth cylinders, and information of block 5 corresponds to the U values of the fifth and sixth cylinders.

By way of supplementary description, output levels of the sensors differ according to the installation positions of the sensors in a case where the two knock sensors 12 and 13 have been installed on the direct in-line six-cylinder engine 1, and so the respective U values of the #1 through #6 cylinders are established in the foregoing block 3 through block 5.

Figure 5A:
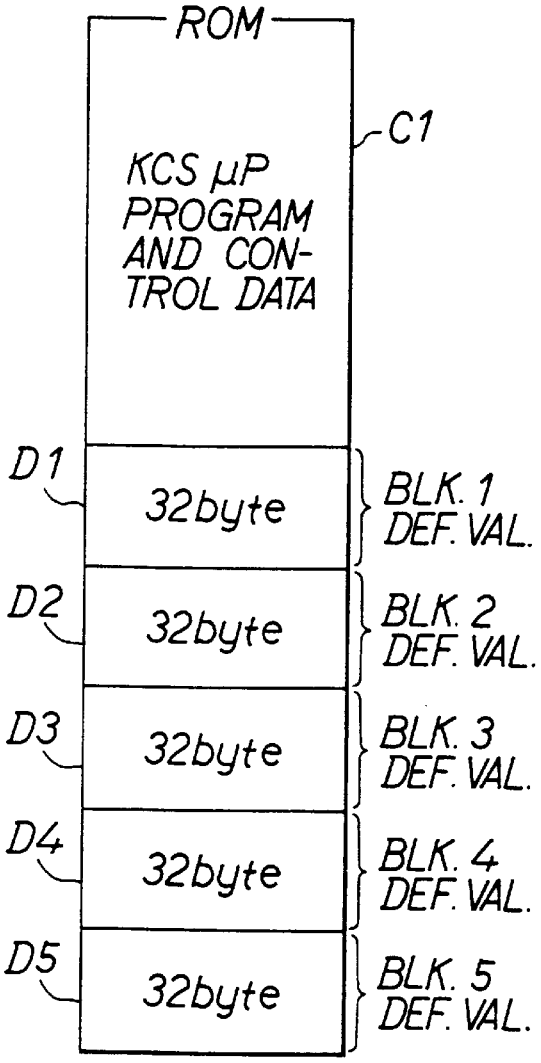
FIGS. 5A and 5B are schematic drawings indicating memory regions of a ROM and memory regions of a RAM of a KCS microprocessor according to the embodiment.
Figure 5B:
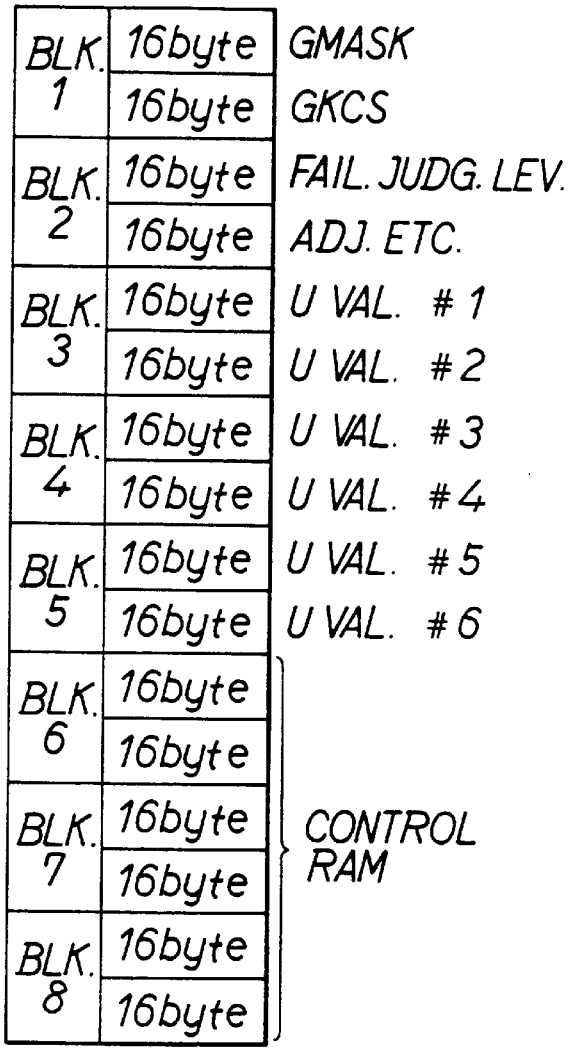

FIGS. 5A and 5B schematically show memory regions of the ROM 41 and memory regions of the RAM 42 of the KCS microprocessor 40. In FIG. 5A, the ROM 41 is provided with a C1 region in which operation programs and control data of the KCS microprocessor 40 are stored, and D1 through D5 regions in which control information (default values) of the KCS microprocessor 40 is stored. The several memory regions B1 through B5 are divided into 32 byte blocks, and default values corresponding to the above-described block 1 through block 5 are established in the respective regions.

Further, in FIG. 5B, memory regions of block 1 through block 8 respectively divided into 32 bytes are provided in the RAM 42. In this case, the above-described various data (GMASK, GKCS, failure-determination levels, ADJ value, and U values for cylinders #1 through #6) are stored in block 1 through block 5, and calculation data computed by the KCS microprocessor 40 is temporarily stored in block 6 through block 8.

Figure 6:
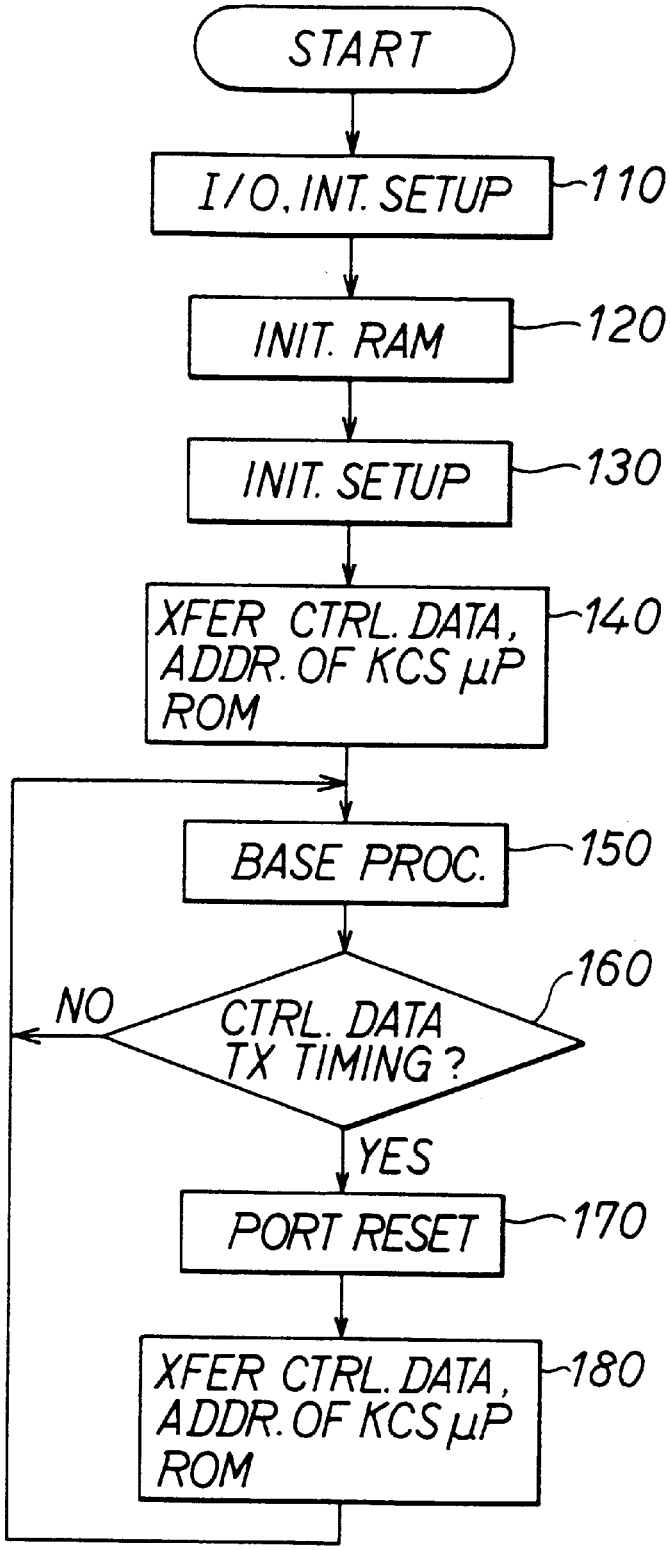
FIG. 6 is a flowchart indicating an operation program executed by a CPU of the host microprocessor in the embodiment.
Figure 7:
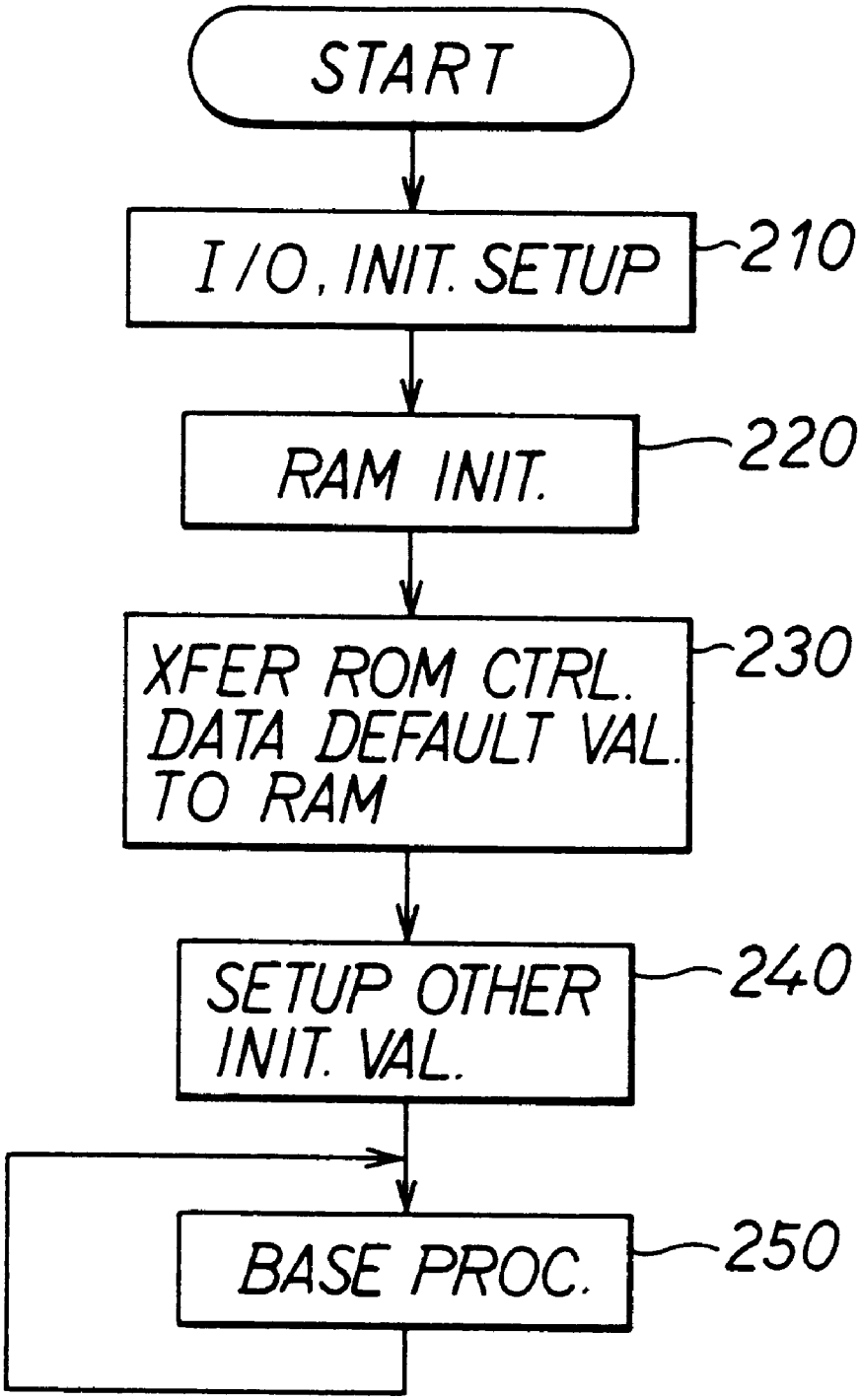
FIG. 7 is a flowchart indicating an operation program executed by a CPU of the KCS microprocessor in the embodiment.
Figures 8A, 8B:
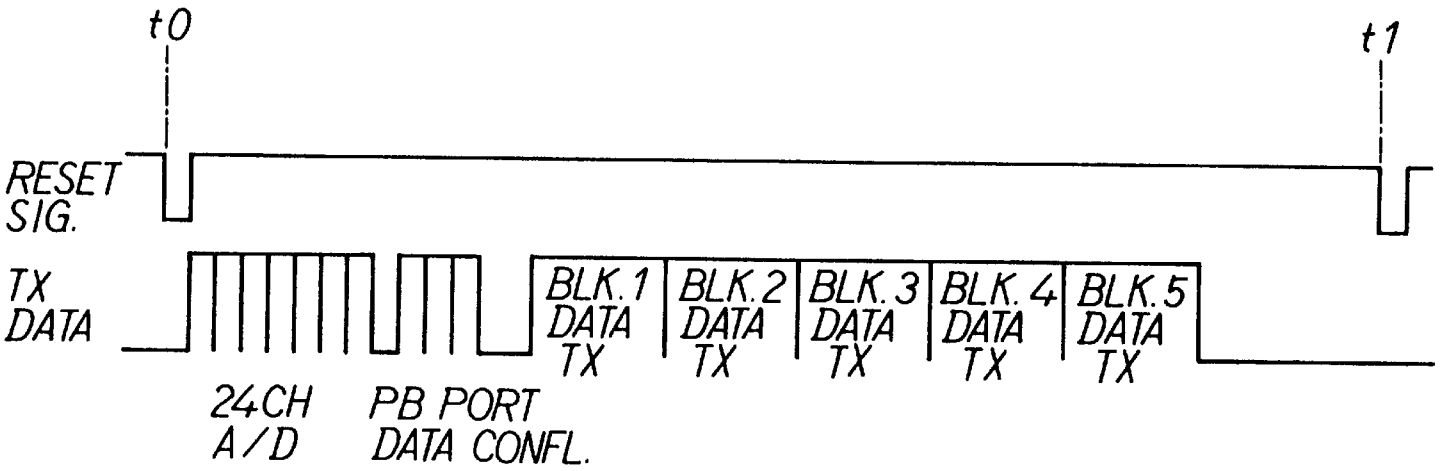
FIGS. 8A and 8B are time charts indicating specifically a content of communication immediately subsequently to application of power in the embodiment.
Figures 9A, 9B, 9C, 9D:
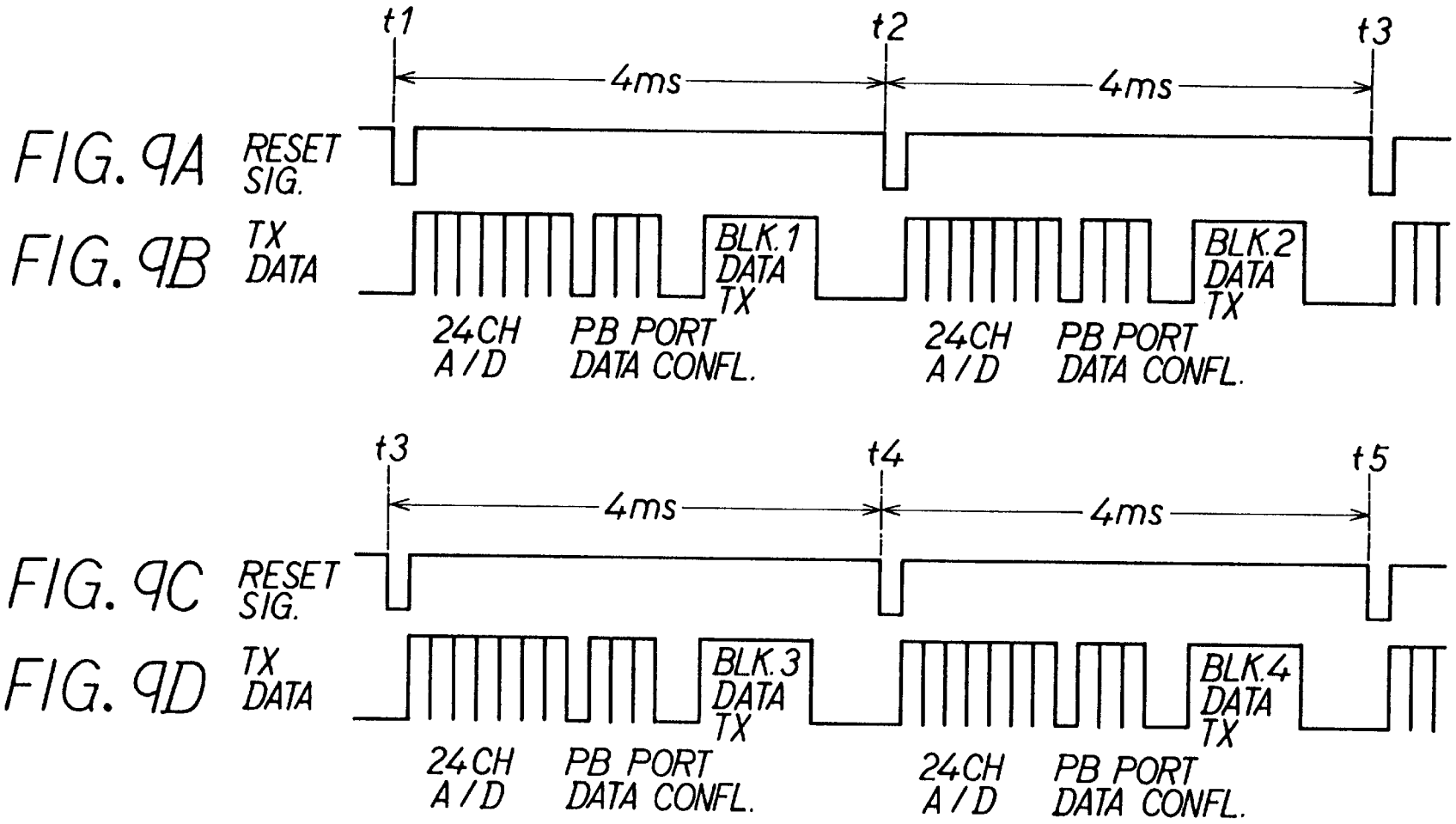
FIGS. 9A–9D are time charts indicating specifically a content of communication during normal operation of the embodiment.

A processing operation of the host microprocessor 30 and KCS microprocessor 40 will be described hereinafter with reference to FIGS. 6 through 9. FIG. 6 is a flowchart showing an operation program executed by the CPU 33 of the host microprocessor 30 responsive to application of power, and FIG. 7 is a flowchart indicating an operation program executed by the CPU 43 of the KCS microprocessor 40 similarly upon application of power. FIGS. 8A, 8B and 9A–9D are time charts specifically indicating the content of data communication. Of these, FIGS. 8A and 8B show operation immediately subsequently to application of a power source, and FIGS. 9A–9D show operation during normal running.

The program of FIG. 6 starts when power is applied to the ECU 20, and in step 110 the CPU 33 within the host microprocessor 30 firstly performs input-output and interrupt initialization. In addition, the CPU 33 initializes the RAM 32 in step 120, followed by setting the initial values in step 130. Further, in step 140 the CPU 33 sends the control data (i.e., the control information in block 1 through block 5) of the KCS microprocessor 40 stored in the B1 through B5 regions of the ROM 31 (see FIG. 4), as well as the destinations (addresses) for the data.

That is to say, in FIG. 8A, a reset signal is generated when power is applied (time t0), and in accompaniment thereto, communication of 24-channel A/D conversion data (intake-air amount, intake temperature, water temperature, and so on) and communication of PB port output (starter signal and so on) is performed. In continuation thereto, the control data of block 1 through block 5 is sent from the host microprocessor 30 to the KCS microprocessor 40. At this time, data is communicated directly between the DMA controllers 34 and 44 in the two microprocessors 30 and 40 without going through the CPUs 33 and 43, and the ROM data of the host microprocessor 30 is sent to predetermined addresses (block 1 through block 5 of FIG. 5 (*b*)) of the RAM 42 for the KCS microprocessor 40.

Thereafter, the CPU 33 performs base processing in step 150. Herein, base processing includes computation to generate an ignition timing signal for ignition timing control, computation of a fuel injection quantity relating to fuel injection control, and the like.

Further, in step 160 the CPU 33 determines whether the timing for sending the ROM data of the host microprocessor 30 to the KCS microprocessor 40 has occurred, and advances to step 170 only when an affirmative determination has been made in step 160. In specific terms, engine information (24-channel A/D conversion data and PB port output) is sent from the KCS microprocessor 40 to the host microprocessor 30 at a predetermined cycle (i.e., every 4 ms), and so it is determined whether 4 ms have elapsed since the previous sending time to send the ROM data of the host microprocessor 30 during this free time.

Accordingly, if the sending time has arrived, the CPU 33 advances to step 170 and resets the communication port. Additionally, in the following step 180 the CPU 33 sends the control data of the KCS microprocessor 40 stored in the B1 through B5 regions of the ROM 31 (see FIG. 4), as well as the destinations (addresses) for the data. At this time, the ROM data is sent in block units in a sending sequence of block 1→block 2→block 3→block 4→block 5→block 1 at each processing opportunity.

That is to say, as shown in FIGS. 9A–9D, 24-channel A/D conversion data communication and PB port output communication is performed at time t1, and in continuation thereto, the control data of block 1 is sent. Additionally, at time t2, 24-channel A/D conversion data communication and PB port output communication is again performed, and the control data of block 2 is sent in continuation thereto. Thereafter, in a similar fashion, the control data of block 3 is sent at time t3, the control data of block 4 is sent at time t4, and the control data of block 5 is sent at time t5.

In this case, because the data (control data of block 1 through block 5) of the B1 through B5 regions of the ROM 31 of the host microprocessor 30 is sent in block units at every 4 ms, sending of all data is completed in 20 ms.

In the above-described way, in the processing of FIG. 6 all data of block 1 through block 5 is sent once at the time of initialization immediately subsequently to application of a power source (step 140), and thereafter any one of block 1 through block 1 is sent sequentially at each processing opportunity (step 180).

Meanwhile, similarly to the foregoing FIG. 6, when the program of FIG. 7 is started upon application of power to the ECU 20, the CPU 43 of the KCS microprocessor 40 firstly performs input-output and interrupt initialization in step 210. Additionally, the CPU 43 initializes the RAM 42 in step 220, followed by setting the initial values in the RAM 42 in step 230. At this time, the CPU 43 sends the default values (i.e., the data of the D1 through D5 regions in FIG. 5(*a*)) within the ROM 42 to predetermined addresses (block 1 through block 5) in the RAM 42.

Further, in step 240 the CPU 43 sets other initial values. In continuation, in step 250 the CPU 43 executes base processing in step 150. Herein, base processing includes gate setting at a time when knocking is detected, receipt of A/D values, failure-determination of the knock sensors, and the like.

In such a case as in FIG. 7, if ROM data is not reliably sent from the host microprocessor 30 to the KCS microprocessor 40 immediately subsequently to application of a power source, the CPU 43 of the KCS microprocessor 40 employs the default values to execute computation for knock detection, failure determination, and so on. Additionally, if ROM data is reliably sent from the host microprocessor 30 to the KCS microprocessor 40, the RAM 42 (default values) of the KCS microprocessor 40 is overwritten with the ROM data from the host microprocessor 30, and the CPU 43 of the KCS microprocessor 40 employs the foregoing ROM data (type-specific control data) to execute processing.

As was described above in detail, according to the present embodiment, specific data which is changed for each vehicle is set in the ROM 31 of the host microprocessor 30 (i.e., the first microprocessor), and the KCS microprocessor 40 (i.e., the second microprocessor) employs the ROM data (i.e., the specific data utilized by the KCS microprocessor 40) of the host microprocessor 30 to perform processing, and standardization of the KCS microprocessor 40 is achieved thereby. At this time, the ROM data of the host microprocessor 30 is sent to the KCS microprocessor 40 at a predetermined cycle, and so even if the RAM data of the KCS microprocessor 40 were to be destroyed, the RAM data can thereafter be restored. In specific terms, the RAM data can be restored in not more than 20 ms at the longest in a case of the above-described embodiment. As a result thereof, problems such as faulty control at a time of RAM destruction or the like can be solved.

Additionally, according to the present embodiment, a system is structured whereby detection data of an engine operating state detected by the KCS microprocessor 40 is sent to the host microprocessor 30 at a predetermined cycle (i.e., every 4 ms), and sending of ROM data is performed during free time other than an interval when the foregoing detection data is being sent. Further, during this data-sending time, the ROM data is divided into a plurality of blocks, and the data is sent block by block. In this case, priority is given to performing the sending of the detection data for the engine operating state, and correct data communication between the two microprocessors 30 and 40 can be performed without affecting control by the host microprocessor 30. Moreover, because the amount of ROM data sent at one time is small during normal operation, there is no chance of a problem such as partially incorrect sending of data due to insufficient sending time.

Furthermore, according to the present embodiment, default values relating to the content of control of the KCS microprocessor 40 are priorly stored in the ROM 41 of the microprocessor 40, and the KCS microprocessor 40 performs initial settings of the RAM data in accordance with the default values. In this case, control by the KCS microprocessor 40 can be started even if faulty sending of the ROM data from the host microprocessor 30 to the KCS microprocessor 40 were to occur upon a start of control by the KCS microprocessor 40 (i.e., upon application of a power source).

Still further, according to the present embodiment, a reset of the communication circuit is performed prior to starting communication, and thereafter communication is started. For this reason, faulty operation of the communication circuit can be reduced.

Moreover, in addition to the above-described embodiment, the present invention can be embodied in a mode which will be described hereinafter.

According to the foregoing embodiment, the DMA controller 44 of the KCS microprocessor 40 was employed to update RAM data without going through the CPU 43, but communication may of course be performed by the CPU 43. In this case, a RAM-data updating device is implemented by the CPU 43.

Additionally, the foregoing embodiment was an embodiment of the present invention in an engine control device which executes knock control, but the present invention may also be embodied in an engine control device which executes other control, such as variable valve timing (VVT) control. Additionally, the present invention may also be embodied for other vehicle control, for example switching control of an automatic transmission, hydraulic control for a brake system, and so on.

Although the present invention has been fully described in connection with the preferred embodiment thereof with reference to the accompanying drawings, it is to be noted that various changes and modifications will become apparent to those skilled in the art. Such changes and modifications are to be understood as being included within the scope of the present invention as defined by the appended claims.

What is claimed is:

1. An electronic control device for automotive use comprising:

a first microprocessor and a second microprocessor communicably connected to one another, each including a memory and a processing unit;

sending means, in said first microprocessor, for sending data in said memory of said first microprocessor relating to content of control of said second microprocessor at a plurality of times during device operation; and updating means, in said second microprocessor, for updating data in said memory of said second microprocessor according to said data from said memory of said first microprocessor sent from said sending means.

2. An electronic control device for automotive use according to claim 1, wherein:

said second microprocessor is for sequentially detecting an operating state of a vehicle, and for sending said operating state data to said first microprocessor at a predetermined cycle;

said first microprocessor is for electronically controlling actuators of said vehicle based on said operating state data;

said sending means sends memory data relating to control content of said second microprocessor during time other than a period when vehicle operating_state data is sent.

3. An electronic control device for automotive use according to claim 2, wherein said sending means is for sending memory data relating to control content of said second microprocessor divided into a plurality of blocks.

4. An electronic control device for automotive use according to claim 3, wherein data sent and received in each block is at least one of a value corresponding to a between-gate open time, a value corresponding to a between-gate closed time, a failure-determination level to determine whether two knock sensors are normal, a conformity value established for each engine, and a constant to correct a knock-determination level of each cylinder.

5. An electronic control device for automotive use according to claim 2, wherein said sending means sends said memory data responsive to completion of data reception from said second microprocessor.

6. An electronic control device for automotive use according to claim 5, wherein said sending means sends said memory data during time other than a period when vehicle operating state data is sent.

7. An electronic control device for automotive use according to claim 2, wherein data indicating a vehicle state is at least one of an intake air quantity, an intake air temperature, a knock signal, and a starter signal.

8. An electronic control device for automotive use according to claim 1, wherein said second microprocessor is for performing control based on control data stored in said memory of said second microprocessor.

9. An electronic control device for automotive use according to claim 1, further comprising:

a bidirectional communication line connecting said first and second microprocessors;

wherein said sending means is for sending said memory data over said communication line.

10. An electronic control device for automotive use according to claim 1, further comprising:

direct memory access means in each of said first and second microprocessors, each of said direct memory access means being for directly accessing said memory and said RAM of its respective microprocessor directly and independently of said processing unit of said respective microprocessor.

11. An electronic control device for automotive use according to claim 1, wherein:

control data corresponding to engine types and specifications is stored in said memory of said first microprocessor.

12. An electronic control device for automotive use according to claim 1, wherein a microprocessor reset period is established prior to a start of communication of said first microprocessor and said second microprocessor.

13. An electronic control device for automotive use according to claim 1, wherein transmission of said second microprocessor is performed with priority.

14. An electronic control device for automotive use according to claim 1, wherein said data relating to content of control is sent according to a predetermined cycle.

15. An electronic control device for automotive use according to claim 1, wherein said memory of each of said first and second microprocessors comprises a ROM and a RAM.

16. An electronic control device for automotive use according to claim 15, wherein:

default values relating to said content of control of said second microprocessor are stored in said ROM of said second microprocessor; and said updating means also initializes data in said RAM according to said default values.

17. An electronic control device for automotive use according to claim 16, wherein at a time of data abnormality within said RAM of said second microprocessor, control is executed on a basis of a default value sent by said sending means from said ROM of said second microprocessor.

18. An electronic control device for automotive use according to claim 17, wherein said time of data abnormality is a time of power-up of said second microprocessor.

19. An electronic control device for automotive use according to claim 1, wherein said second microprocessor executes control based on a default value stored in said memory of said second microprocessor when said data relating to content of control is not accurately received.

20. A microprocessor comprising:

vehicle state signal input means for inputting and processing at least one input signal;

a memory storing default values for general use as first control data;

a processing unit for performing processing based on a vehicle state obtained from said first control data of said memory and from said vehicle state signal input means; and direct memory access means for sending processing results from said processing unit at each predetermined cycle without going through said processing unit, and for receiving second control data from an external device and directly updating contents of said memory with this second data as first control data.

21. A microprocessor according to claim 20, wherein said vehicle state signal input means is for processing a digital signal which is at least one of an rpm speed and a starter signal of an internal combustion engine.

22. A microprocessor according to claim 20, wherein said vehicle state signal input means is for processing an analog signal which is at least one of a knock signal, a water temperature, an intake-air quantity, and an intake-air temperature of an internal combustion engine.

23. A microprocessor according to claim 20, wherein said vehicle state signal input means includes converting means for converting an analog signal inputted thereto into a digital signal.

24. A microprocessor according to claim 23, wherein data transmitted as said analog signal by said external device is data representative of at least one of a vehicle operating state and an engine operating state.

25. A microprocessor according to claim 20, wherein said vehicle state signal input means includes digital signal input means for receiving a digital signal and detecting input of the same.

26. A microprocessor according to claim 20, wherein said external device includes at least one of a microprocessor and a memory.

* * * * *